US007547267B1

(12) United States Patent
Wang

(10) Patent No.: US 7,547,267 B1
(45) Date of Patent: Jun. 16, 2009

(54) MANUAL SLOPE-ADJUSTING MECHANISM FOR AN ELLIPTICAL CROSS TRAINER

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 12/061,625

(22) Filed: Apr. 2, 2008

(51) Int. Cl.
*A63B 22/06* (2006.01)
*A63B 22/12* (2006.01)

(52) U.S. Cl. ..... 482/52; 482/57; 482/51

(58) Field of Classification Search ..... 482/51–57
See application file for complete search history.

(56) References Cited

U.S. PATENT DOCUMENTS 6,422,977 B1 * 7/2002 Eschenbach ..... 482/52
6,440,042 B2 * 8/2002 Eschenbach ..... 482/52
6,442,996 B1 * 9/2002 Thurston et al. ..... 73/24.01
7,060,005 B2 * 6/2006 Carlsen et al. ..... 482/52

* cited by examiner

*Primary Examiner*—Steve R Crow

(57) ABSTRACT

A manual slope-adjusting mechanism for an elliptical cross trainer having a front sleeve with side tubes at both sides of the bottom of the front end of the elliptical cross trainer. An upright tube is positioned at the center of the front sleeve. A toothed portion is formed at the top of the upright tube. Moreover, a control lever is attached to a coupling rod disposed within an upright support of the elliptical cross trainer. The other end of the coupling rod enables an up-and-down movement of a locking element such that the locking element can be engaged into or disengaged from the toothed portion of the upright tube. In this way, the supporting angle of the side tubes can be manually adjusted for adjusting the slope of the plank connecting rods.

1 Claim, 5 Drawing Sheets

MANUAL SLOPE-ADJUSTING MECHANISM FOR AN ELLIPTICAL CROSS TRAINER

BACKGROUND OF THE INVENTION

1. Fields of the Invention

The invention relates to a manual slope-adjusting mechanism for an elliptical cross trainer, and more particularly, to an easily and manually adjusting structure for achieving an economic, practical and convenient effect.

2. Description of the Related Art

In order to achieve an effective adjustment of the exercise slope of the plank connecting rod of an elliptical cross trainer, a lifting motor unit is cooperated with coupling elements for adjusting the slope and the height of the plank connecting rod. In this way, expected and different exercise paces can be achieved.

The electric adjustment mechanism can achieve a rapid and convenient operation and finds favor with the consumers. However, the addition of the electric lifting adjustment mechanism causes a higher production cost of the elliptical cross trainer. Therefore, the price of the elliptical cross trainer in the market is correspondingly higher. Thus, many consumers cannot afford it.

SUMMARY OF THE INVENTION

An object of the invention is to provide a manual slope-adjusting mechanism for an elliptical cross trainer utilizing a simple and manual adjusting mechanism instead of the electric adjusting mechanism for achieving a considerable reduction of the production cost. In this way, an economic, practical and convenient elliptical cross trainer is achieved. Moreover, it is avoidable that many consumers cannot afford the beneficial fitness apparatus due to the high price thereof.

According to the invention, a manual slope-adjusting mechanism for an elliptical cross trainer having a front sleeve with side tubes at both sides of the bottom of the front end of the elliptical cross trainer. An upright tube is positioned at the center of the front sleeve. A toothed portion is formed at the top of the upright tube. Moreover, a control lever is attached to a coupling rod disposed within an upright support of the elliptical cross trainer. The other end of the coupling rod enables an up-and-down movement of a locking element such that the locking element can be engaged into or disengaged from the toothed portion of the upright tube. In this way, the supporting angle of the side tubes can be manually adjusted for adjusting the slope of the plank connecting rods.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

The present invention will now be described in more detail hereinafter with reference to the accompanying drawings that show various embodiments of the invention.

Figure 1:
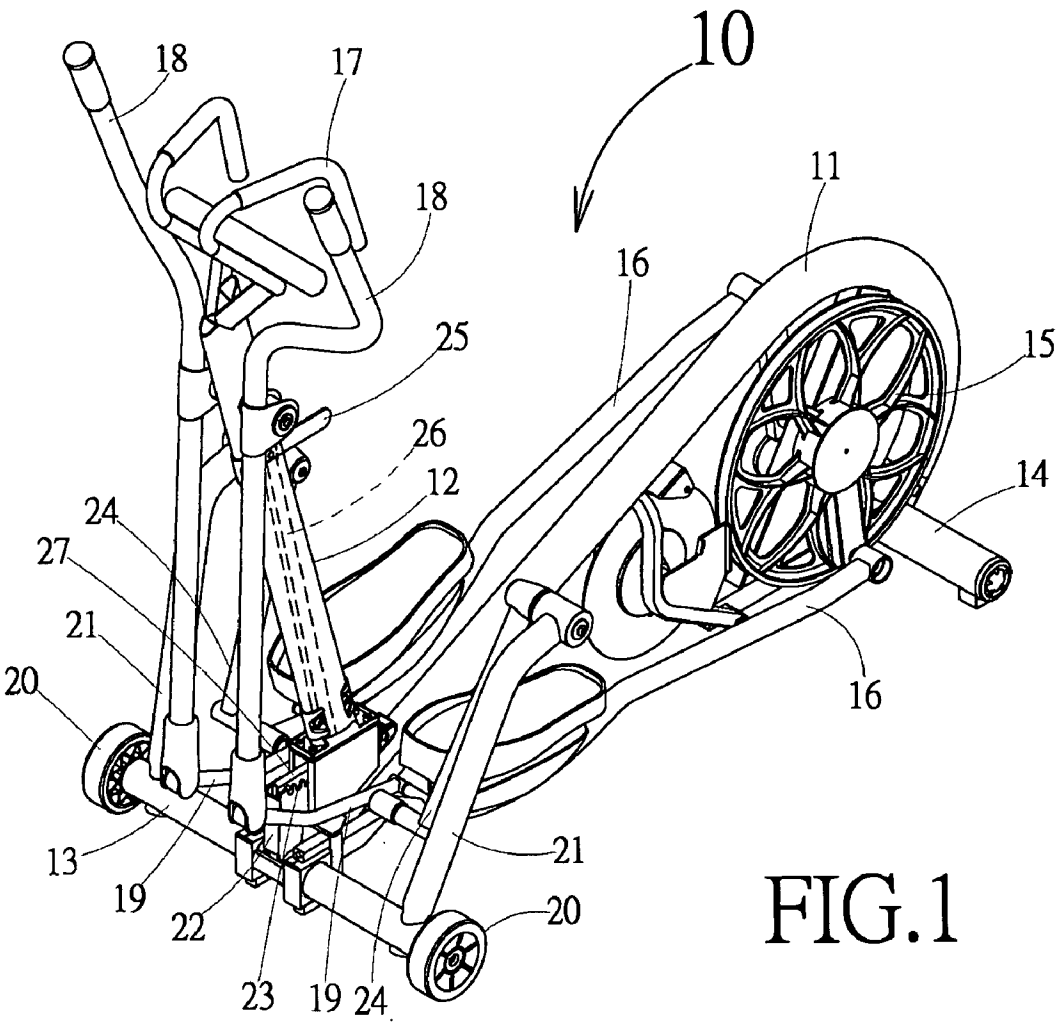
FIG. 1 is a perspective assembly view of the invention.

Referring to FIG. 1, an elliptical cross trainer 10 includes a main frame 11, an upright support 12, a front sleeve 13, a rear ground-touching tube 14, a flywheel drive assembly 15, and two plank connecting rods 16. A fixed handrail assembly 17 is disposed at the top of the main frame 11. Two movable handrails 18 are pivotally connected to both sides of the main frame 11. Meanwhile, a connecting rod 19 is pivotally coupled to the bottom of the movable handrails 18 for creating a coupling state with the plank connecting rods 16. The front sleeve 13 and the main frame 11 are pivotally coupled. Each of both ends of the front sleeve 13 is provided with a ground-touching roller 20. Moreover, a side tube 21 is integrally disposed at both sides thereof, respectively. An upright tube 22 is positioned at the center thereof. A toothed portion 23 is formed at the top of the upright tube 22. A suspension arm 24 is pivotally interposed between the top of the side tube 21 and the plank connecting rod 16 such that the exercise slope of the plank connecting rods 16 may be determined and adjusted.

Moreover, a control lever 25 is attached to a coupling rod 26 disposed within the upright support 12. The other end of the coupling rod 26 enables an up-and-down movement of a locking element 27. One end of the locking element 27 is pivotally connected to a certain portion of the main frame 11 such that the locking element 27 can be engaged into or disengaged from the toothed portion 23 of the upright tube 22. In this way, the supporting angle of the side tubes 21 can be manually adjusted for adjusting the slope of the plank connecting rods 16.

Figure 4:
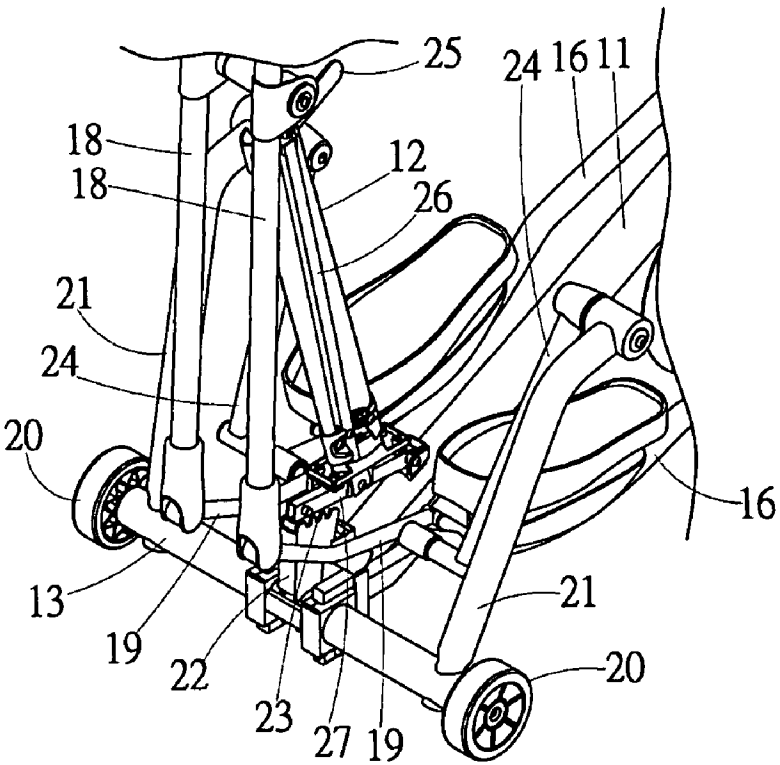
FIG. 4 is a perspective and partial view of the invention with the adjusting mechanism in an unlocked state.
Figure 2:
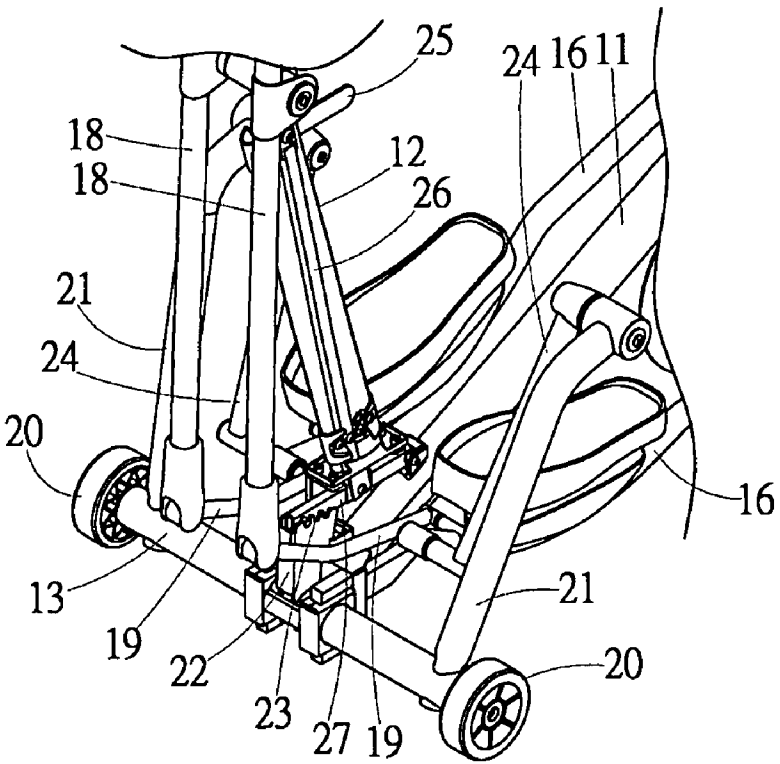
FIG. 2 is a perspective and partial view of the invention with the adjusting mechanism in a locked state.
Figure 5:
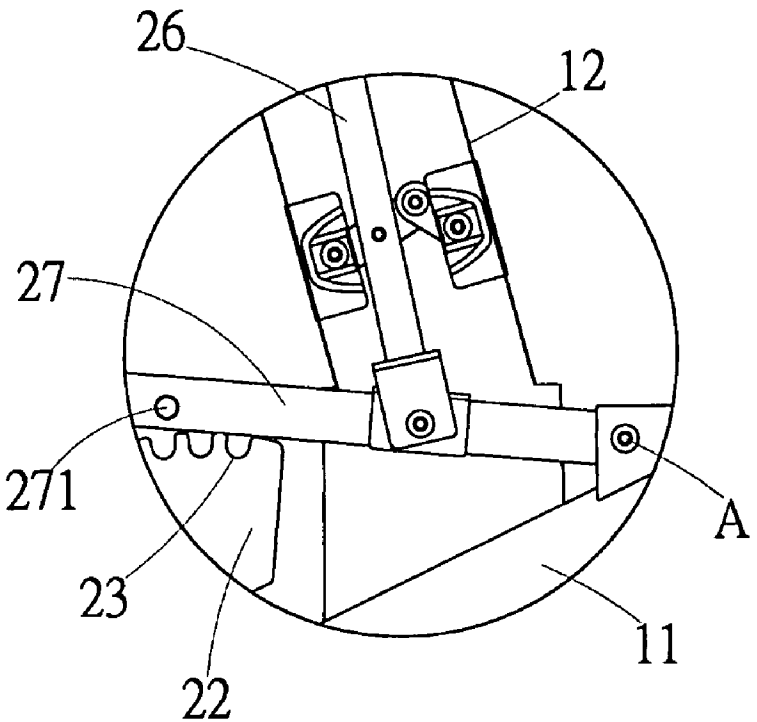
FIG. 5 is an enlarged view of FIG. 4.
Figure 3:
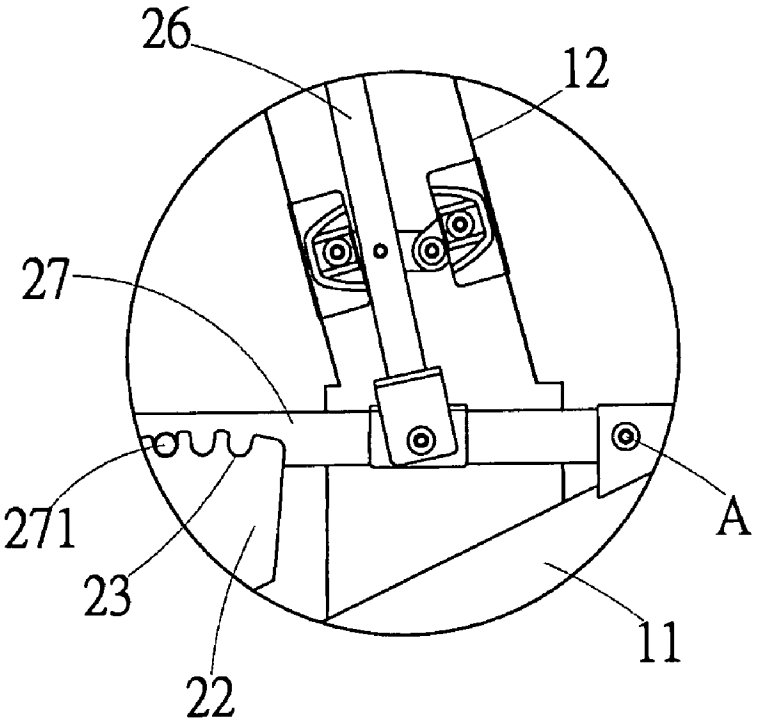
FIG. 3 is an enlarged view of FIG. 2.

As shown in FIGS. 2 and 3, the locking element 27 is compressed by the coupling rod 26 such that locking bolts 271 at both sides thereof are engaged into one of recesses of the toothed portion 23 of the upright tube 22 when the control lever 25 is pressed down. At this time, the front sleeve 13 and the side tube 21 are locked into a non-pivotal state. As shown in FIGS. 4 and 5, the locking element 27 is pulled by the coupling rod 26 to rotate on a pivotal pin A of the main frame 11 such that the locking bolts 271 at both sides thereof are disengaged from the toothed portion 23 of the upright tube 22 when the control lever 25 is pulled upwards. At this time, the front sleeve 13 and the side tube 21 are movable into a pivotal state.

Figure 6:
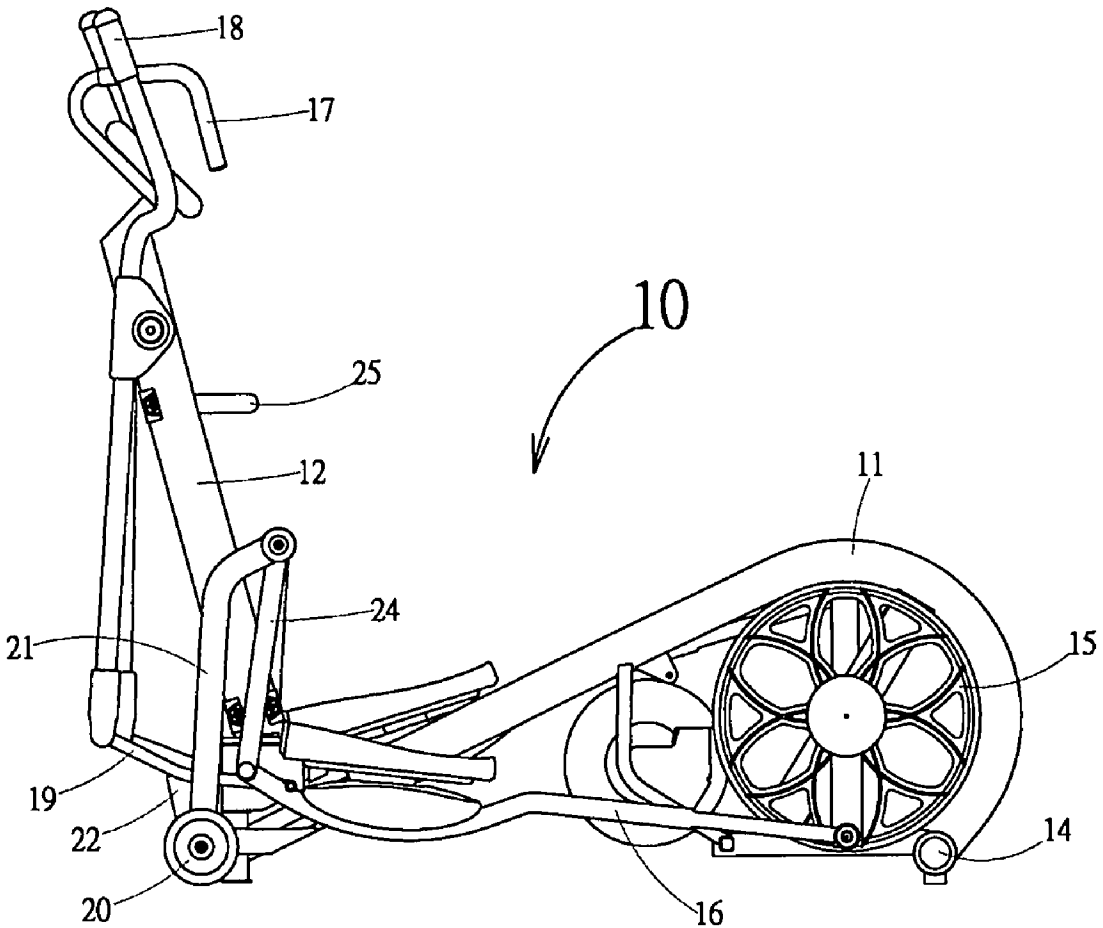
FIG. 6 is a side view of FIG. 2.
Figure 7:
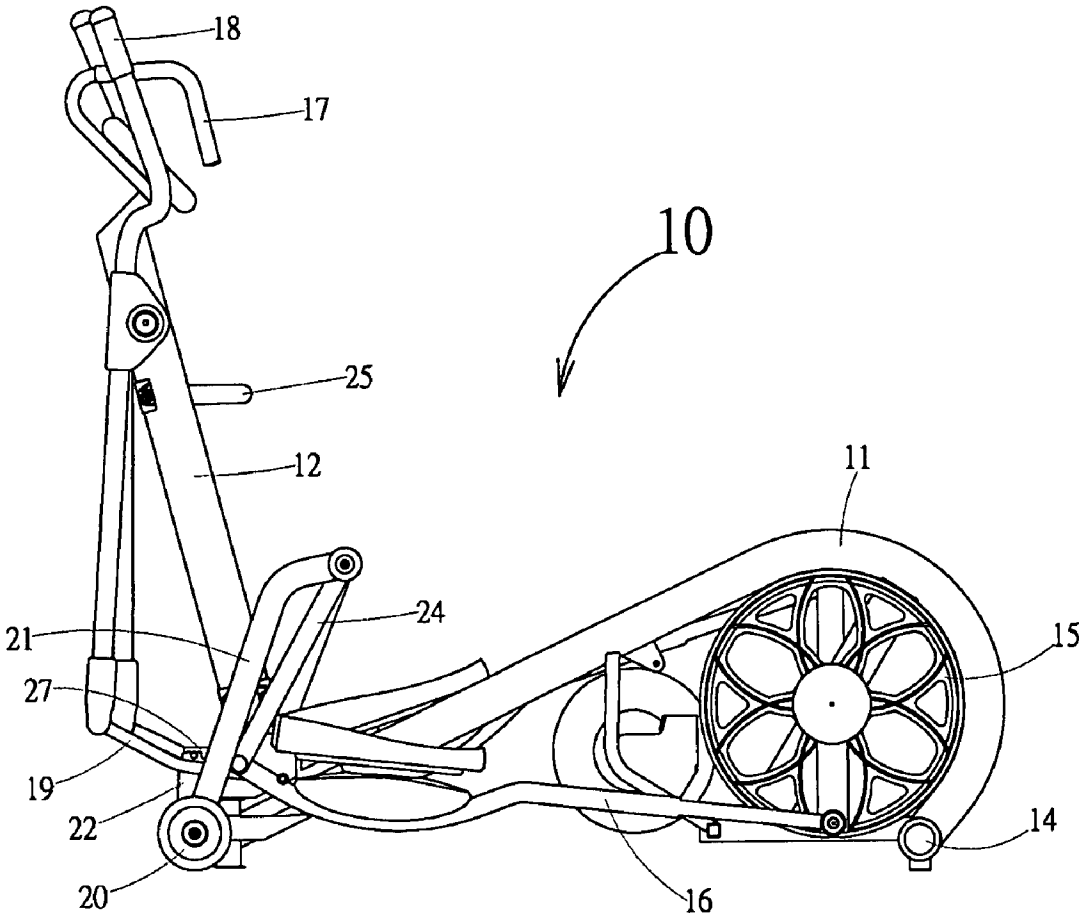
FIG. 7 is a side view of FIG. 4.

As shown in FIGS. 6 and 7, the operator may adjust the exercise slope of the plank connecting rods 16 as desired for meeting the exercise demands.

The interaction between the flywheel drive assembly 15 and both plank connecting rods 16 belongs to the prior art and is not the object of the invention. Therefore, no further descriptions thereto are given hereinafter.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A manual slope-adjusting mechanism for an elliptical cross trainer having a main frame, an upright support, a front sleeve, a rear ground-touching tube, a flywheel drive assembly, and two plank connecting rods, wherein a fixed handrail assembly is disposed at the top of the main frame, and two movable handrails are pivotally connected to both sides of the main frame, and a connecting rod is pivotally coupled to the bottom of the movable handrails for coupling with the plank connecting rods;

wherein the front sleeve and the main frame are pivotally coupled, and each of both ends of the front sleeve are provided with a ground-touching roller, and a side tube is integrally disposed at both sides thereof, respectively, and an upright tube is positioned at the center thereof, and a toothed portion is formed at the top of the upright tube, a suspension arm is pivotally interposed between the top of the side tube and the plank connecting rod such that the exercise slope of the plank connecting rods may be adjusted; a locking mechanism and wherein a control lever is attached to a coupling rod disposed within the upright support, and the other end of the coupling rod enables an up-and-down movement of locking element, and one end of the locking element is pivotally connected to the main frame such that the locking element can be engaged into or disengaged from the toothed portion of the upright tube; therefore, the supporting angle of the side tubes can be manually adjusted for adjusting the slope of the plank connecting rods.

* * * * *